US007422276B2

(12) United States Patent
Flannery

(10) Patent No.: US 7,422,276 B2
(45) Date of Patent: Sep. 9, 2008

(54) FOLDING CHILD BOOSTER SEAT

(75) Inventor: Mark A Flannery, Lakeville, MN (US)

(73) Assignee: Regalo International, LLC, Prior Lake, MN (US)

( * ) Notice: Subject to any disclaimer, the term of this patent is extended or adjusted under 35 U.S.C. 154(b) by 0 days.

(21) Appl. No.: 11/337,310

(22) Filed: Jan. 22, 2006

(65) Prior Publication Data

US 2006/0163922 A1 Jul. 27, 2006

Related U.S. Application Data

(60) Provisional application No. 60/646,859, filed on Jan. 24, 2005.

(51) Int. Cl.
*A47D 1/10* (2006.01)

(52) U.S. Cl. ..... 297/16.2; 297/250.1; 297/255

(58) Field of Classification Search ..... 297/16.2, 297/45, 250.1, 254, 255
See application file for complete search history.

(56) References Cited

U.S. PATENT DOCUMENTS 834,383 A * 10/1906 Johnson ..... 297/152
1,397,281 A * 11/1921 Haas ..... 297/250.1
3,606,453 A * 9/1971 Cicero ..... 297/254
3,838,883 A * 10/1974 Machen ..... 297/16.2
4,652,047 A * 3/1987 Chan ..... 297/45
5,335,968 A * 8/1994 Sheridan et al. ..... 297/250.1
6,382,715 B1 * 5/2002 Tang ..... 297/16.2
6,871,905 B2 * 3/2005 Grace ..... 297/16.2
6,899,383 B2 * 5/2005 Hwang ..... 297/16.2

* cited by examiner

*Primary Examiner*—Peter R Brown

(57) ABSTRACT

A folding child booster seat having a frame portion and a seat portion. The frame portion includes foot hubs, seat hubs, and a set of pivoting support members joining the foot hubs and the seat hubs. The frame portion further includes a pair of seat back support members where each of the seat back support members is engaged to one of the foot hubs and is slideably engaged to one of the seat hubs. The pivoting support members includes front, rear, right side and left side pairs of pivoting support members. Stops on the seat back support members limit a sliding of the hubs that slideably engage the seat back support members to minimize an opening of the frame portion, and flexible members engaged between the foot hubs can further minimize an opening of the frame portion. The seat portion is engaged to two of the seat hubs and is further slideably engaged to the seat back support members. The foot hubs include disk portions for stability and the seat hubs include disk portions for pushing up the seat portion when the frame portion is collapsed.

21 Claims, 6 Drawing Sheets

10
20
20
114
86
122
94
88
84
114
90
26
25
50
22
24
78
34

20
98
114
100
27
14
18
10
50
66
25
25
72
78
78
74
72
124

FOLDING CHILD BOOSTER SEAT

This application claims the benefit under 35 U.S.C. 119(e) of U.S. Provisional Patent Application No. 60/646,859 filed Jan. 24, 2005. Such provisional application is hereby incorporated by reference in its entirety into this application.

FIELD OF THE INVENTION

The present invention relates generally to child seats, particularly child booster seats, and specifically to folding child booster seats.

BACKGROUND OF THE INVENTION

A booster or booster seat is a seat for a younger child that boosts or lifts the younger child up to the level of a table such that the younger child is generally at the level of older children, teenagers or adults and such that the child can eat or play at the table. The booster seat may be of a box type that sits on the seat of a chair and that does not engage the table. The booster seat may be of the type that engages the edge of the table and hangs off the edge of the table.

SUMMARY OF THE INVENTION

A feature of the present invention is the provision in a folding child booster seat, of a frame portion having a set of foot hubs engaging a set of seat hubs via pairs of pivotally joined support members.

Another feature of the present invention is the provision in a folding child booster seat, of front, rear, right side and left side pairs of pivotally joined support members.

Another feature of the present invention is the provision in a folding child booster seat, of frame portion having a set of foot hubs engaging a set of seat hubs, and further having a pair of seat back support members where each of the seat back support members engage a foot hub and slideably engage a seat hub.

Another feature of the present invention is the provision in a folding child booster seat, of a flexible member extending between at least two of the foot hubs, with the flexible member being in a generally extended position when the frame portion is in an open position to aid the frame portion-from further opening.

Another feature of the present invention is the provision in a folding child booster seat, of such a flexible member being paired with each of the pairs of pivotally joined support members.

Another feature of the present invention is the provision in a folding child booster seat, of a frame portion having a set of foot hubs, a set of seat hubs, a set of pivoting support members engaged between the sets of hubs, and a set of back seat support members slideably engaging at least two of the seat hubs, and of a stop on at least one of the back seat support members to stop a sliding of at least one of the seat hubs relative to its respective back seat support member to stop the frame portion from further opening.

Another feature of the present invention is the provision in a folding child booster seat, of a frame portion having a set of foot hubs, a set of seat hubs, and pivoting support members between the sets, and of a closed position where the foot hubs are grouped together and where the seat hubs are grouped together, and of an open position where the foot hubs are spaced apart and where the seat hubs are spaced apart.

Another feature of the present invention is the provision in a folding child booster seat, of a frame portion having a set of foot hubs, and of each of the foot hubs having a face of a relatively great surface area lying to provide stability for the frame portion relative to an object that the face portion confronts.

Another feature of the present invention is the provision in a folding child booster seat, of a frame portion having a set of seat hubs, of a seat portion, and of each of the seat hubs having a face of a relatively great surface area for confronting and pushing up corner sections of the seat portion when the frame portion is being collapsed from an open position to a closed position.

Another feature of the present invention is the provision in a folding child booster seat, of a frame portion having a set of seat hubs and a pair of seat back support members, and of a seat portion being engaged to at least two of the seat hubs and further being slideably engaged to each of the seat back support members.

Another feature of the present invention is the provision in a folding child booster seat, of the frame portion having a minimum of upright and vertically extending legs, of the frame portion having, at a front portion, no upright and vertically extending legs, and of the frame portion having, at a rear portion, a set of two upright and vertically extending legs.

Another feature of the present invention is the provision in a folding child booster seat, of the frame portion having no perfectly horizontally extending support members, where a support member is a relatively rigid tube or rod preferably formed of a metal or composite material.

An advantage of the present invention is appearance. The folding child booster seat of the present invention has the appearance of a sport chair that mom or dad place along the sideline of a soccer field.

Another advantage of the present invention is safety. One feature that contributes to this advantage is the plurality of stops. Each of the seat back support members includes a stop to stop its respective seat hub from sliding further in the direction of the foot hub and hence to stop the seat from further opening. Further, each of the pairs of pivotally joined support members is paired with a respective flexible member extending between the foot hubs of such pair so as to stop pairs of pivotally joined support members from opening further. Still further, the fabric of the seat portion is another stop or lock that keeps the pivoting support members from opening too far. Another feature that contributes to this advantage is the seat portion that includes side sections, along with a seat bottom section and a seat back section such that the booster seat surrounds the child on three sides, including the right side, the left side, and the back side.

Another advantage of the present invention is cost. The folding child booster seat is relatively inexpensive to manufacture.

Another advantage of the present invention is that the seat portion is removable from the frame portion and thereby washable in a washing machine.

Another advantage of the present invention is size. The folding child booster seat is relatively small when in operation and when collapsed to a closed position. When open and in operation as a booster seat, the folding child booster seat can sit on and be anchored to a conventional chair. When closed, the booster seat can be readily stored in a small bag.

Another advantage of the present invention is ease of operation. The present child booster seat is easily opened from the closed position and is easily closed to the closed position. The present child booster seat is easily anchored via two independent fasteners to a conventional chair.

DESCRIPTION

Figure 1:
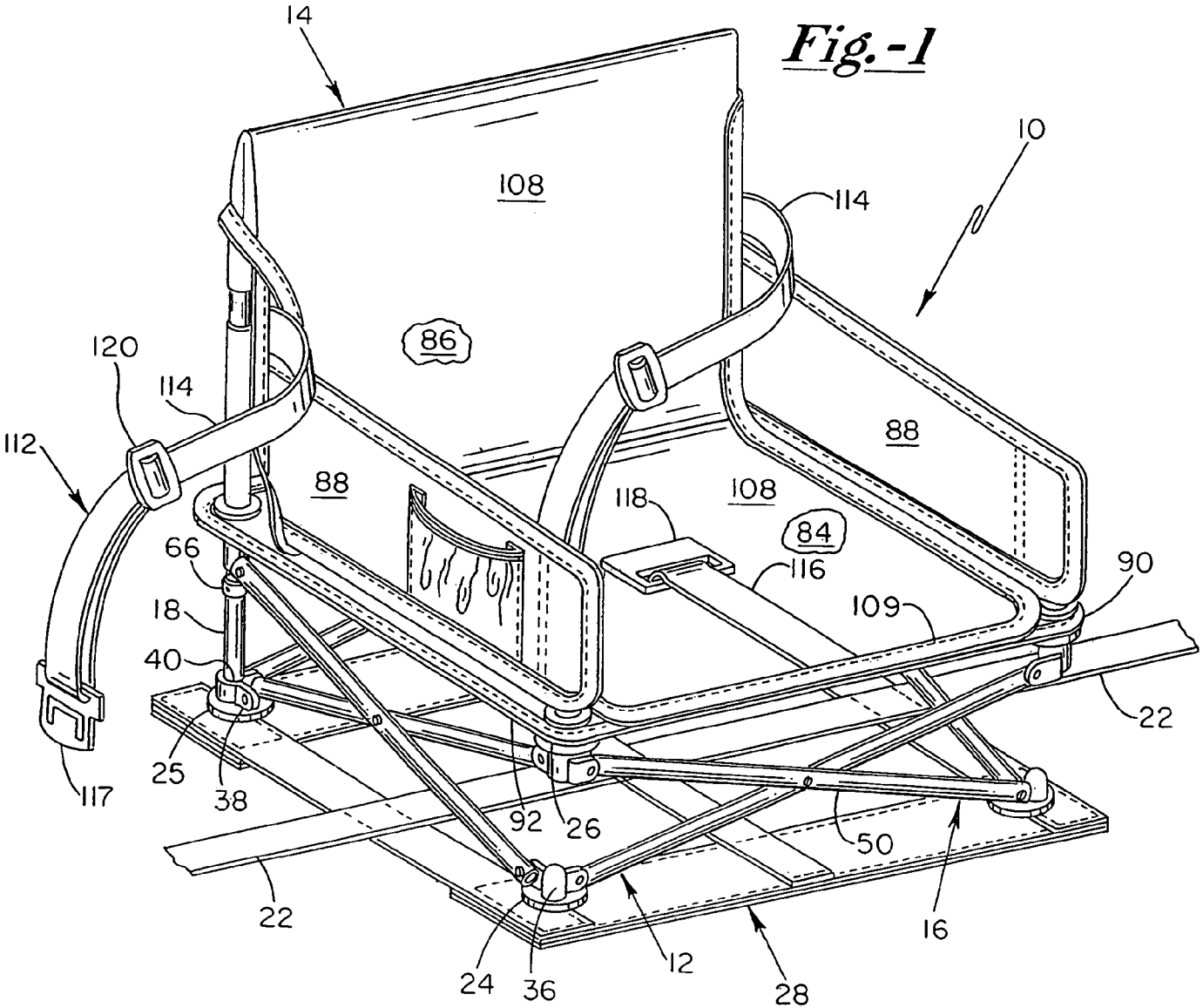
FIG. 1 is a perspective view of the present folding child booster seat in the open position.

As shown in FIG. 1, the present folding child booster seat is indicated in general by the reference numeral 10. The folding child booster seat 10 generally includes a frame portion 12, a seat portion 14, a pivoting support member arrangement 16, a pair of seat back support members 18, a first fastener 20, a second fastener 22, a set of front foot hubs 24, a set of rear foot hubs 25, a set of seat hubs 26, and a set 28 of flexible base members.

Figure 2:
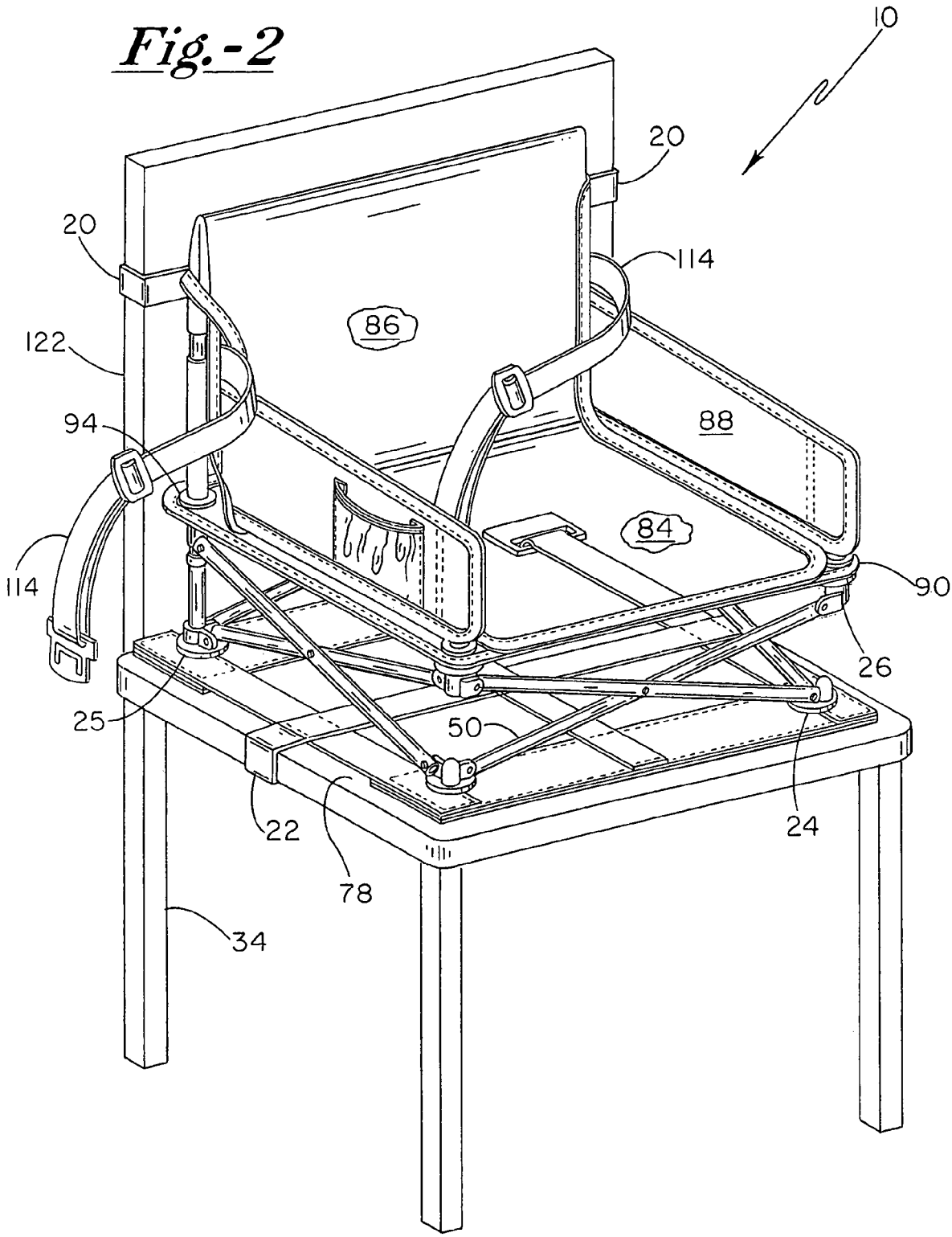
FIG. 2 is a perspective and environmental view of the folding child booster of FIG. 1 anchored to a conventional chair.
Figure 4:
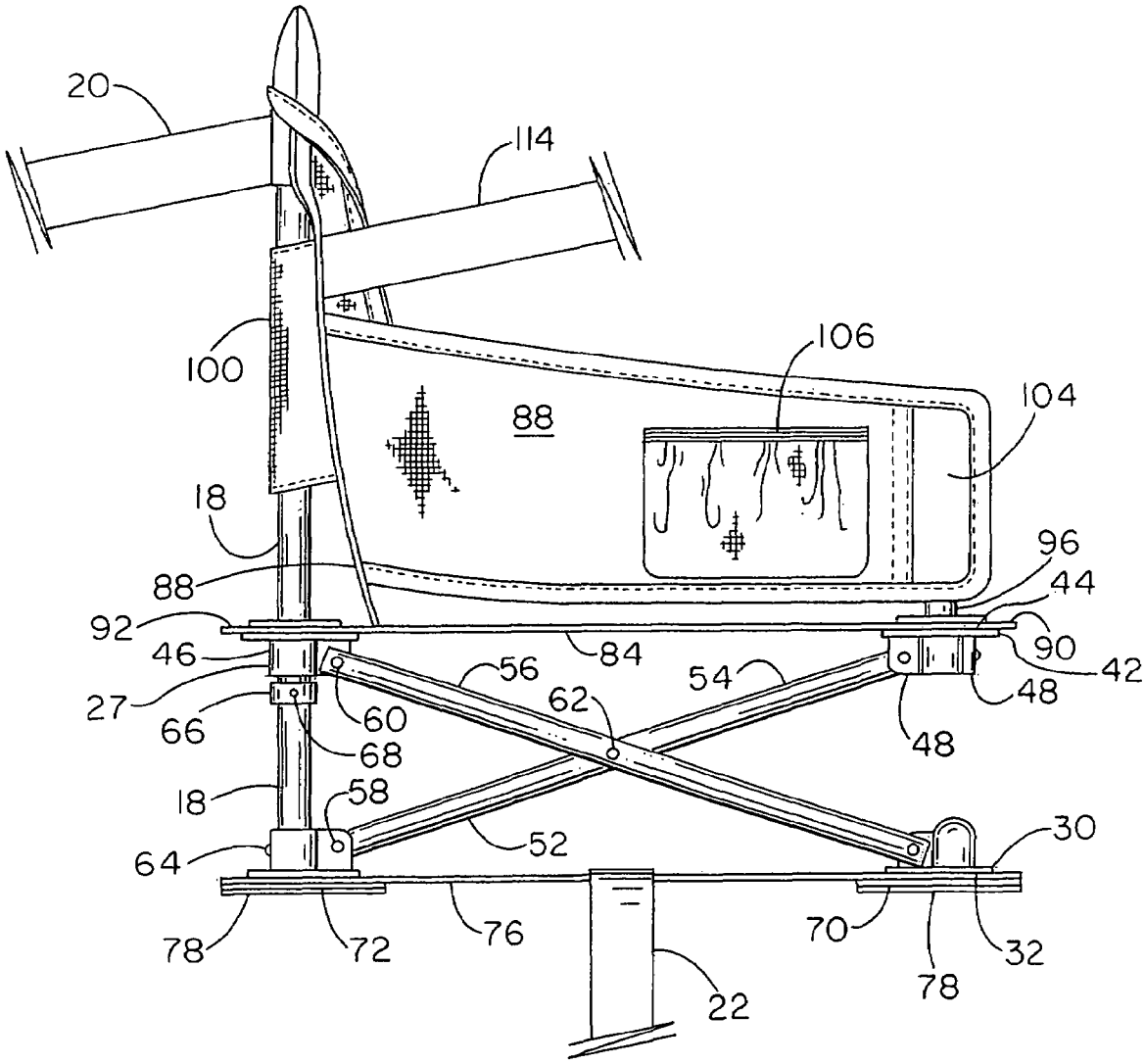
FIG. 4 is a right side view of the folding child booster seat of FIG. 1.
Figure 5:
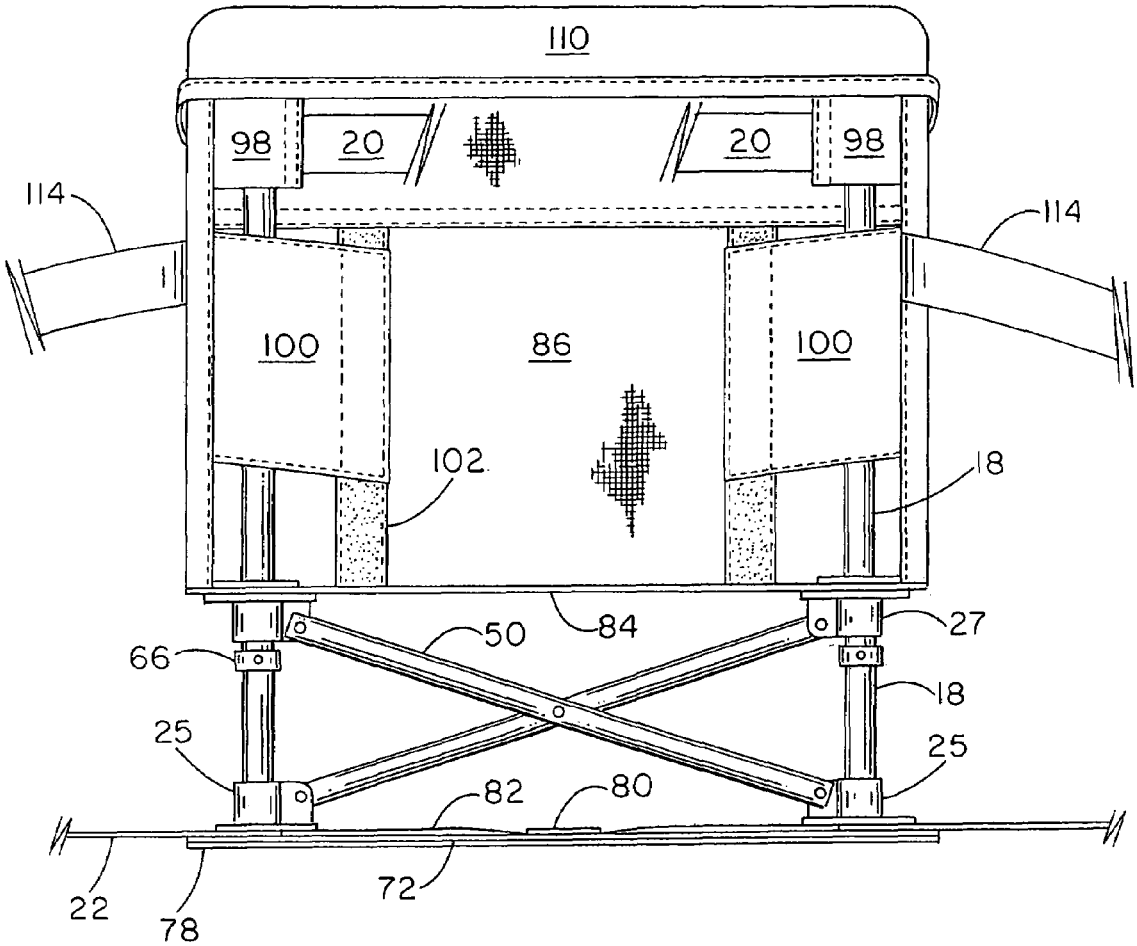
FIG. 5 is a rear view of the folding child booster seat of FIG. 1.
Figure 6:
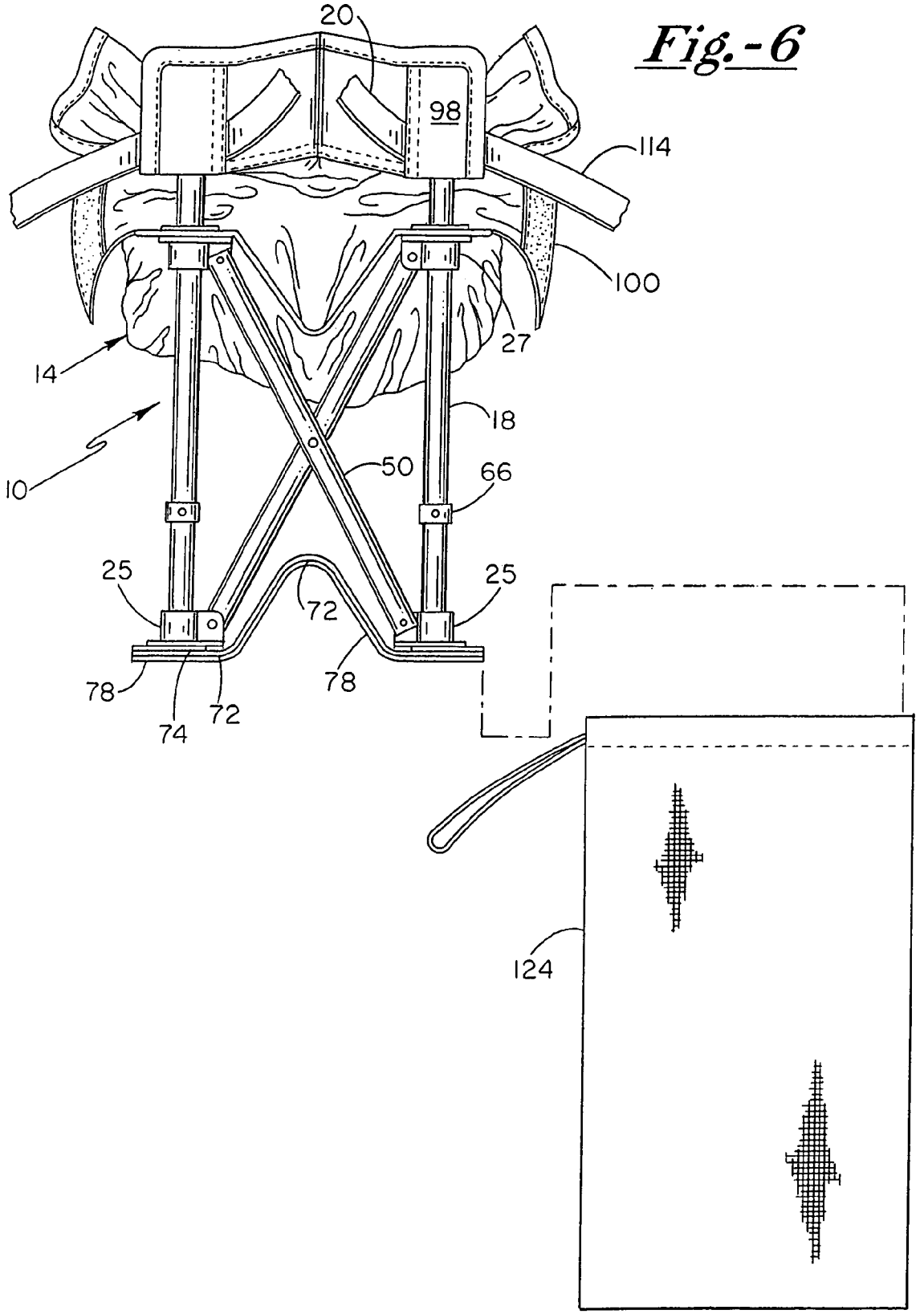
FIG. 6 is a rear view of the folding child booster seat of FIG. 1 in a closed position and shows the folding child booster seat relative to a bag for storing the folding child booster seat in the closed position.

More specifically, each of the front foot hubs 24 and rear foot hubs 25 includes, as shown in FIG. 4, an integral disk portion 30 having a lower face 32 for providing stability relative to an object such as a chair 34 shown in FIG. 2. Each of the front foot hubs 24 and rear foot hubs 25 further includes, as shown in FIG. 1, an integral off-center upright projection 36 offset from a central point of the disk portion 30 and a pair of walls 38 that extend at right angles relative to each other, that are integral with the off center upright projection 36, and that are further integral with the disk portion 30. Each of the off-center upright projections 36 of the rear foot hubs 25 includes a receptor 40 for one of the seat back support members 18. Each of the disk portions 30 are in a common first plane with each of the other disk portions 30 when the folding child booster seat 10 is in an open position, as shown in FIG. 1, when the folding child booster seat 10 is in a closed position, as shown in FIG. 6, and when the folding child booster seat 10 is in transition between such positions.

Each of the front seat hubs 26 and each of the rear seat hubs 27 includes, as shown in FIG. 4, an integral disk portion 42 having an upper face 44 for confronting and pushing up corner sections of the seat portion 14 when the folding child booster seat 10 is collapsed from an open position to a closed position. Each of the front seat hubs 26 and each of the rear seat hubs 27 further includes, as shown in FIG. 4, an integral off-center downward projection 46 offset from a central point of the disk portion 42 and at least a pair of walls 48 that extend at right angles relative to each other, that are integral with the off center downward projection 46, and that are further integral with the disk portion 42. Each of the off-center downward projections 46 of rear seat hubs 27 includes a through opening for slideably receiving one respective seat back support member 18. Each of the disk portions 42 are in a common first plane with each of the other disk portions 42 when the folding child booster seat 10 is in an open position, as shown in FIG. 1, when the folding child booster seat 10 is in a closed position, as shown in FIG. 6, and when the folding child booster seat 10 is in transition between such positions.

Each of the hubs 24, 25, 26 and 27 can be formed of a metal, plastic or composite material. Plastic is preferred.

The pivoting support member arrangement 16 includes a set of pivoting support members 50. Each of the pivoting support members 50 includes a first end portion 52, a second end portion 54, and an intermediate portion 56, as shown in FIG. 4. The first end portion 52 of each of the pivoting support members 50 is pivotally engaged to one of the front foot hubs 24 or one of the rear foot hubs 25 at one of the walls 38 via a pin connector 58. The second end portion 54 of each of the pivoting support members 50 is pivotally engaged to one of the front seat hubs 26 or one of the rear seat hubs 27 at one of the walls 48 via a pin connector 60. The intermediate portion 56 of each of the pivoting support members 50 is pivotally engaged to the intermediate portion 56 of a paired pivoting support member 50 via a pin connector 62.

Hubs 24, 25, 26 and 27 can include further walls, other than walls 38, 48 for anchoring the distal end portions of the pivoting support members 50. Such other walls can extend parallel to the walls 38, 48 such that a distal end portion is received between hub walls and pivotally joined between such walls via a pin connector extending to and between the two such parallel walls.

The pivoting support member arrangement 16 includes front, rear, right side, and left side pairs of pivoting support members 50. Each pair of pivoting support members 50 can be referred to as a crossing structure or an "X" structure such that the pivoting support member arrangement 16 includes front, rear, right side, and left side "X" structures. Folding child booster seat 10 is open and closed via the pivoting support member arrangement 16.

Each of the pivoting support members 50 can be formed of a metal, plastic or composite material. Each of the pivoting support members 50 can be solid or rod like or hollow and tubular. Each of the pivoting support members 50 is relatively rigid. Each of the pivoting support members 50 is preferably a metal tube.

Frame portion 12 includes the pivoting support member arrangement 16 and further includes the seat back support members 18. Each of the seat back support members 18 is fixed at a lower end portion to one of the rear foot hubs 25 in the off center projection 36. Such lower end portion may be somewhat tapered to engage such off center projection. A pin 64 extending through the off center projection 36 can fix such lower end in its respective rear foot hub 25. Each of the seat back support members 18 is slideably received in a through opening extending through off center projection 46 of each of the rear seat hubs 27. Each of the seat back support members 18 is further slideably received in rear corner section of the seat portion 14, where such rear corner section can be reinforced with a grommet or reinforced eyelet. Each of the seat back support members 18 can be referred to as a rear leg or as a guide for the opening and closing of the pivoting support member arrangement 16.

Each of the seat back support members 18 includes a stop 66 that can be fixed at a desired position on its respective seat back support member 18 via a pin 68. Stop 66 is cylindrical in shape so as to extend around seat back support member 18 as shown in FIGS. 1, 2, 4, 5, and 6 and includes an upper surface that can confront and abut a lower surface of downward off center projection 46 of rear seat hubs 27 so as to stop a sliding downward movement of rear seat hubs 27 and so as to stop an opening of the pivoting support member arrangement 16. Prior to weight being placed in the seat portion 14, such upper surface of stop 66 can be slightly spaced from such lower surface of downward off center projection 46.

Each of the seat back support members 18 can be formed of a metal, plastic or composite material. Each of the seat back support members 18 can be solid or rod like or hollow and tubular. Each of the seat back support members 18 is relatively rigid. Each of the seat back support members 18 is preferably a metal tube.

Figure 3:
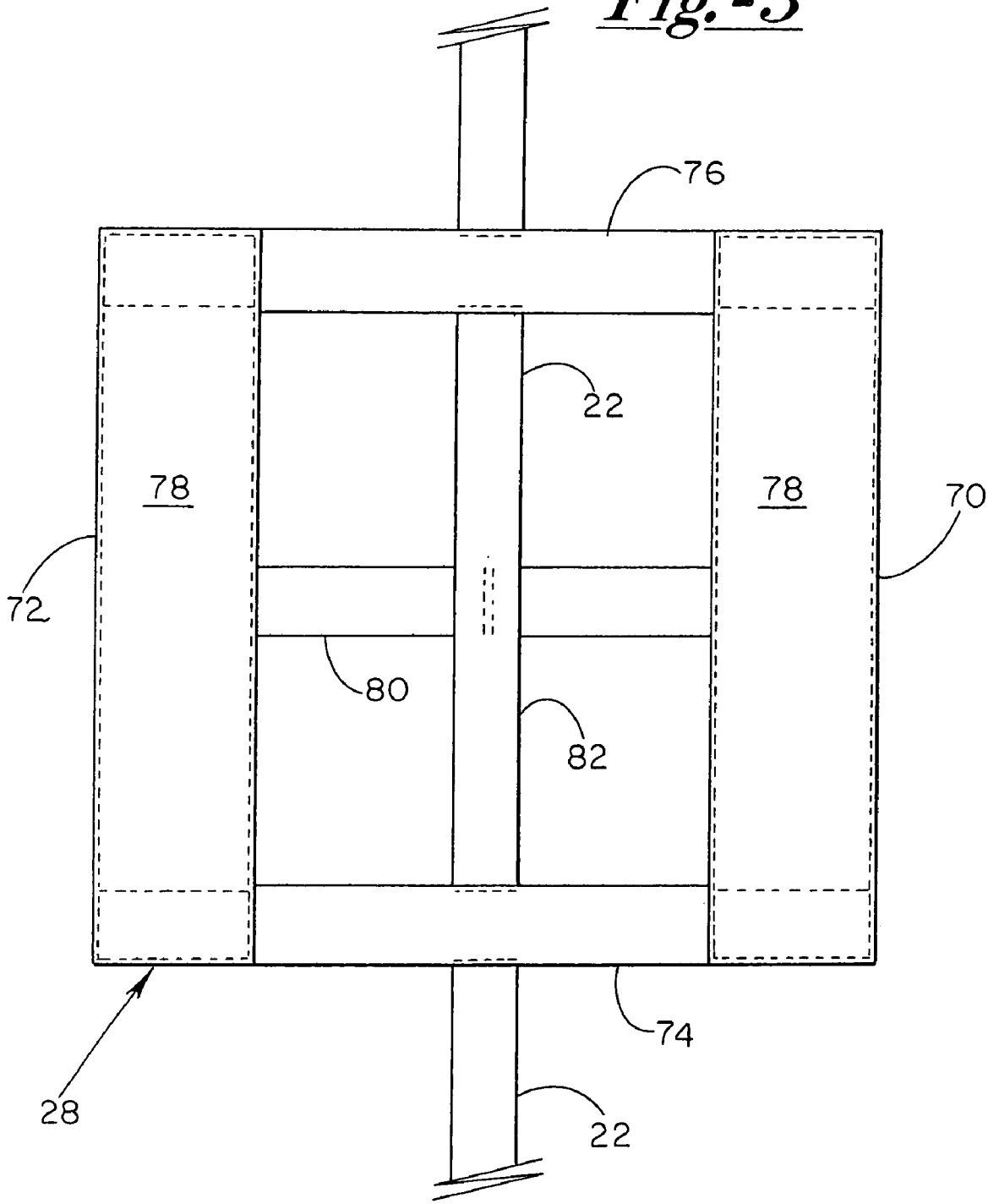
FIG. 3 is a bottom view of the folding child booster seat of FIG. 1.

As shown in FIG. 3, folding child booster seat 10 further includes the set 28 of flexible base members. Such set 28 preferably includes four flexible base members, including a front flexible base member 70, a rear flexible base member 72, a left side flexible base member 74 and a right side flexible base member 76. Each of the front and rear flexible base members 70, 72 is relatively wide and includes a roughened rubber or rubber like underside or grip 78 for minimizing any sliding of the folding child booster seat 10 relative to a seat surface 78 of chair 34. Each of the side flexible base members 74, 76 is relatively narrow and interconnects the front and rear flexible base members 70, 72. An intermediate flexible base member 80 interconnects front and rear flexible base members 70, 72 via medial sections of members 70, 72. Second fastener 22 is engaged to side flexible base members 74 and 76 and is further engaged to intermediate flexible base member 80 such that second fastener 22 functions as a flexible base member. End portions of flexible base members 70, 72, 74 and 76 are engaged to each other via stitching and are further engaged to front and rear foot hubs 24, 25 at the faces 32 via connectors such as pin connectors engaging peripheral sections of disk portion 30 such that the flexible base members 70, 72, 74 and 76 extend under and cover the lower faces 32 as shown in FIGS. 1, 2, 3, 4, 5, and 6.

Each of the flexible base members 70, 72, 74 and 76 is paired with one of the pairs of pivoting support members 50 so as to limit or stop or minimize an opening of its respective paired pivoting support members 50. When each of the flexible base members 70, 72, 74 and 76 is relatively fully extended, the pivoting support member arrangement 16 is relatively fully open and each of the pairs of pivoting support members 50 has opened in a scissors fashion to a relatively fully open position. Intermediate flexible member 80, and the portion 82 of fastener 22 between side members 74 and 76, are also relatively fully extended. At such a position, each of the lower surfaces of downward off center projection 46 confronts or abuts the upper surface of its respective stop 66. When the pivoting support member arrangement 16 is closed, the flexible base members 70, 72, 74, 76, 80, and fastener portion 82, flex or fold as the foot hubs 24, 25 are drawn toward each other.

Seat portion 14 is formed of a flexible fabric material such as nylon. Seat portion 14 includes a seat bottom 84, a seat back 86, and seat sides 88. Seat bottom 84 includes a pair of front corner sections 90 and a pair of rear corner sections 92. Each of the corner sections 90, 92 includes a grommet or reinforced eyelet 94. Front corner sections 90, via grommet 94 are fixed to front seat hubs 26 via removable upwardly extending hub extensions 96. Each of the hub extensions 96 is threaded and is engaged to its respective front seat hub 26 via a threaded pin connector. A lower face of hub extension 96 pinches grommet 94 of front corner section 90 to its respective front seat hub 26 such that the front corner sections 90 of seat portion 14 are fixed to such front seat hubs 26. Hub extension 96 can be screwed off hub 26 such that seat portion 14 can be removed from frame portion 14. The grommets 94 of rear seat hubs 27 slideably receive one respective seat back support member 18. Grommet 94 has a lesser diameter than the faces 44 of each of the seat hubs 26, 27 such that the faces 44 push up and confront fabric material of seat portion 14. Seat bottom 88 is engaged to seat back 86 and is engaged along right and left side edge portions to seat sides 88.

Seat bottom 84 works, along with flexible base members 70, 72, 74, 76, 80, and 82, and further along with stop 66, to minimize an excessive opening of pivoting support arrangement 16. That is, pressure brought to bear on seat bottom 84, such as a child sitting upon seat bottom 84, tends to minimize a further spreading or scissoring of each of the pairs of pivoting support members 50.

Seat back 86 extends from seat bottom 86 at a location spaced from a rear edge of seat bottom 86, where such location is forwardly of the grommets 94 of the rear corner sections 92, as shown in FIG. 4. At its upper end portion, seat back 86 includes a pair of pockets 98 for removably receiving upper end portions of seat back support members 18. A removable pin can fix each of such upper end portions of seat back support members 18 in and to each of the pockets 98. Seat back 86 further includes a pair of flexible flaps 100. Each of the flaps 100 has a strip of vertically extending hook and/or loop material (or a quick connect material) such as Velcro® to engage another strip 102 of vertically extending hook and/or loop material (or a quick connect material) such as Velcro® so as to form a loop or through opening to engage one respective seat back support member 18 and through which seat back support member 18 is slideable. Strips 102 are engaged to seat back 86. Seat back 86, at pockets 98, engage first fastener 20.

Seat sides 88 include a right seat side and a left seat side. Each of the seat sides 88 have a front pocket 104 in which hub post or hub extension 96 is removably received. Each of the seat sides 88 is engaged at a rear edge to an edge portion of seat back 86. At a medial portion of its lower edge, each of the seat sides 88 is engaged to seat bottom 84. Such an engagement, which terminates short of the front edge of seat bottom 84 and short of the front edge of seat side 88, permits the front portion of seat side 88, having pocket 104, to be lifted up such that pocket 104 can catch the top of hub post or extension 96 such that hub post or extension 96 can slide into pocket 104. It should be noted that each of the seat sides 88, when folding child booster seat 10 is in the open position, is relatively fully extended and resides in a plane generally at a right angle to seat bottom 84 such that seat sides 88 extend in generally a vertical plane. Each of seat sides 88 further includes a piece of mesh stitched to the outside of the right side seat side 88 so as to form a pocket 106 therewith.

Seat portion 14 further includes a removable washable cover 108. Cover 108 is generally a rectangular piece of fabric, such as nylon. A front edge portion of cover 108 is engaged by a hook and loop engagement 109 such as Velcro® or other quick connect, to a front edge portion of seat bottom 84 such that cover 108 is removable and washable separately from the seat bottom 84, seat back 86 and seat sides 88. A rear end portion of cover 108 includes a pocket 110 to removable receive an upper edge portion of seat back 86 drawn taut by virtue of the back seat support members 18 being drawn fully apart by the opening of the pivoting support member arrangement 16. Such pocket 110 also indirectly receives upper end portions of the back seat support members 18. Cover 108 has sufficient length to lay upon the upper face of seat bottom 84 and to lay against the front face of seat back 86.

It should be noted that the perimeter of each of seat bottom 84, seat back 86, seat sides 88, and cover 108 includes a reinforced fabric edge, with the exception of the lower edge of seat back 86 that meets with and engages the seat bottom 84.

Seat portion 14 further includes a child restraint arrangement 112. Restraint arrangement 112 includes a pair of first straps 114 extending from the seat back 86 and a central strap 116 extending from seat bottom 84. Each of straps 114 includes a respective buckle portion 117 that couples with buckle portion 118 of central strap 116. Each of straps 114 includes a buckle portion 120 that provides for length adjustment of its respective strap 114.

First fastener 20 includes a pair of straps having buckle portions or quick connect portions at their distal ends for coupling with each other to anchor the folding child booster seat 10 to a seat back 122 of chair 34.

Second fastener 22 includes a pair of straps having buckle portions or quick connect portions at their distal ends for coupling with each other to anchor the folding child booster seat 10 to a seat bottom 78 of chair 34.

As shown in FIG. 6, a kit for the folding child booster seat 10 can include a bag 124 for receiving the folding child booster seat 10 in a closed position.

In operation, the folding child booster seat 10 is withdrawn from bag 124. Then a hand may be placed on the seat bottom 84 (or cover 108 on the seat bottom 84) to open, in a scissors like fashion, the pivoting support member arrangement 16 until stops 66 confront rear seat hubs 27. Then the folding child booster seat 10 may be placed on a seat bottom 84 of chair 34. Then flaps 100 are engaged to their respective seat back support members 18. Then fasteners 20 and 22 are respectively engaged to the seat back 122 and seat bottom 84 of chair 34. Then a child may be placed in the seat portion 14 and buckled in with restrain arrangement 112. After dinner, the child can be removed from the seat portion 14, whereupon fasteners 20 and 22 can be disengaged from chair 34. Then flaps 100 are disengaged from their respective seat back support members 18 so as to permit the seat back support members 18 to be drawn inwardly toward each other. Then opposing portions of the pivoting support member arrangement 16 can be pushed together so as to collapse, in a scissors like fashion, the pivoting support member arrangement 16, which operation folds the seat portion 14. If desired, the seat sides 88 can be tucked inwardly, the flaps 100 can be tucked inwardly, and the upper end of cover 108 having pocket 110 can be tucked downwardly such that seat sides 88, flaps 100, upper end of cover 108 and the seat portion 14 as a whole can generally be disposed within four posts defined by seat back support members 18 and hub extensions 96 as the frame portion 12 collapses. Such four posts are drawn together as the frame portion 12 collapses and such a drawing in also draws in the seat portion 14 such that folding child booster seat 10 is a compact structure for insertion into bag 124.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A folding child booster seat, comprising:

a) a frame portion comprising:

i) at least four foot hubs located generally in a first plane;

ii) at least four seat hubs located generally in a second plane;

iii) a front X structure engaged between two of the foot hubs and two of the seat hubs;

iv) a rear X structure engaged between two of the foot hubs and two of the seat hubs;

v) a right side X structure engaged between two of the foot hubs and two of the seat hubs;

vi) a left side X structure engaged between two of the foot hubs and two of the seat hubs;

vii) wherein each of the X structures includes a pair of pivoting support members pivotally joined to each other, with each of the pivoting support members having a pair of end portions, with one of said end portions being pivotally joined to one of said foot hubs and with said other of said end portions being pivotally joined to one of said seat hubs; and viii) a pair of seat back support members, with each of the seat back support members engaged to one of the foot hubs, with each of the seat back support members slideably engaged to one of the seat hubs;

b) a seat portion engaged to the frame portion; and c) a flexible member extending between two foot hubs and a fastener comprising a strap for engaging and anchoring the folding child booster seat to an object, with the strap extending from said flexible member.

2. The folding child booster seat of claim 1, wherein each of the X structures is disposed in generally a plane such that said X structures define a front plane, a rear plane, a right side plane and a left side plane.

3. The folding child booster seat of claim 1, with said flexible member being in a generally extended position when the frame portion is in an open position to stop the frame portion from opening further.

4. The folding child booster seat of claim 1, wherein said flexible member engages each of the foot hubs, with said flexible member being in a generally extended position when the frame portion is in an open position to stop the frame portion from opening further.

5. The folding child booster seat of claim 1, wherein said flexible member comprises a right side flexible member for the right side X structure, and wherein said folding child booster seat further comprises a front flexible member for the front X structure, a rear flexible member for the rear X structure, and a left side flexible member for the left side X structure, with each of the X structures having an open position, with said flexible members having a generally extended position, with the flexible members being at said generally extended positions when said X structures are at said open positions.

6. The folding child booster seat of claim 1, and further comprising an anchor for engaging the folding child booster seat to an object, with the anchor comprising a first fastener comprising a strap extending from the seat back support members, and with the anchor further comprising said strap extending from said flexible member.

7. The folding child booster seat of claim 1, and further comprising a stop, with said stop being engaged on one of the seat back support members, with said stop being engaged between one of the foot hubs and one of the seat hubs, and with said stop stopping a sliding of a seat hub relative to the seat back support member on which said seat hub slides such that said stop stops an opening of said frame portion.

8. The folding child booster seat of claim 1, wherein the frame portion includes:

a) a closed position where the four foot hubs are spaced relatively closely to each other, where the four seat hubs are spaced relatively closely to each other, and where each of the foot hubs is spaced relatively far apart from each of the seat hubs; and b) an open position where the four foot hubs are spaced relatively far apart from each other, where the four seat hubs are spaced relatively far apart from each other, and where each of the foot hubs is spaced relatively closely to one of the seat hubs.

9. The folding child booster seat of claim 1, wherein the seat portion comprises at least one flexible section.

10. The folding child booster seat of claim 1, wherein the seat portion comprises a seat bottom flexible section, with the seat bottom flexible section being engaged to at least two of the seat hubs.

11. The folding child booster seat of claim 1, wherein the seat portion comprises a seat bottom flexible section, with the seat bottom flexible section being slideably engaged to each of the seat back support members.

12. The folding child booster seat of claim 1, wherein the seat portion comprises a seat back flexible section, with the seat back flexible section being engaged to each of the seat back support members.

13. The folding child booster seat of claim 1, with the seat portion being engaged to at least two of the seat hubs, and with at least a section of the seat portion being slideably engaged to each of the seat back support members.

14. The folding child booster seat of claim 1, wherein the frame portion further comprises a pair of hub posts, with each of the hub posts extending from one of the seat hubs, and wherein the seat portion comprises a seat back flexible section and a pair of side flexible sections, with each of the side flexible sections extending between one of the hub posts and the seat back flexible section.

15. The folding child booster seat of claim 1, wherein the seat portion comprises a seat bottom flexible section, a seat back flexible section engaged to the seat bottom flexible section, and a pair of side flexible sections engaged to the seat bottom flexible section and to the seat back flexible section, with each of the sections being extended when the frame portion is in an open position.

16. The folding child booster seat of claim 1, wherein each of the foot hubs comprises a face portion lying generally in the first plane to provide stability for the frame portion relative to an object that the disk portion confronts.

17. The folding child booster seat of claim 1, wherein each of the seat hubs comprises a face portion lying generally in the second plane for confronting and pushing up corner sections of the seat portion when the frame portion is collapsed from an open position to a closed position.

18. A folding child booster seat, comprising:

a) a frame portion comprising:

i) at least four foot hubs located generally in a first plane;

ii) at least four seat hubs located generally in a second plane, with each of the seat hubs having a lower surface;

iii) a front X structure engaged between two of the foot hubs and two of the seat hubs;

iv) a rear X structure engaged between two of the foot hubs and two of the seat hubs;

v) a right side X structure engaged between two of the foot hubs and two of the seat hubs;

vi) a left side X structure engaged between two of the foot hubs and two of the seat hubs;

vii) wherein each of the X structures includes a pair of pivoting support members pivotally joined to each other, with each of the pivoting support members having a pair of end portions, with one of said end portions being pivotally joined to one of said foot hubs and with said other of said end portions being pivotally joined to one of said seat hubs; and viii) a pair of seat back support members, with each of the seat back support members engaged to one of the foot hubs, with each of the seat back support members slideably engaged to one of the seat hubs;

b) a seat portion engaged to the frame portion; and c) a stop, with said stop being cylindrical in shape, with said stop being engaged on one of the seat back support members, with said stop being fixed to said seat back support member at a desired position, with said stop extending around said seat back support member, with said stop being engaged between one of the foot hubs and one of the seat hubs, with said stop stopping a sliding of a seat hub relative to the seat back support member on which said seat hub slides such that said stop stops an opening of said frame portion, and with said stop having an upper surface that confronts and abuts said lower surface of said seat hub when said frame portion is fully open.

19. A folding child booster seat, comprising:

a) a frame portion comprising:

i) at least four foot hubs located generally in a first plane;

ii) at least four seat hubs located generally in a second plane, with two of said at least four seat hubs having a hub post, and with said hub post extending upwardly;

iii) a front X structure engaged between two of the foot hubs and two of the seat hubs;

iv) a rear X structure engaged between two of the foot hubs and two of the seat hubs;

v) a right side X structure engaged between two of the foot hubs and two of the seat hubs;

vi) a left side X structure engaged between two of the foot hubs and two of the seat hubs;

vii) wherein each of the X structures includes a pair of pivoting support members pivotally joined to each other, with each of the pivoting support members having a pair of end portions, with one of said end portions being pivotally joined to one of said foot hubs and with said other of said end portions being pivotally joined to one of said seat hubs; and viii) a pair of seat back support members, with each of the seat back support members engaged to one of the foot hubs, with each of the seat back support members slideably engaged to one of the seat hubs;

b) a seat portion engaged to the frame portion, wherein the seat portion comprises:

i) a seat bottom comprising a seat bottom flexible section, with the seat bottom flexible section being engaged to said hub post of at least two of the seat hubs, with the seat bottom flexible section being engaged to each of the seat back support members;

ii) a seat back comprising a seat back flexible section engaged to the seat bottom flexible section, with the seat back flexible section being engaged to each of the seat back support members, with the seat back flexible section having a pair of pockets for receiving upper end portions of said seat back support members;

iii) a pair of seat sides, with each of the seat sides comprising a side flexible section engaged to the seat bottom flexible section and to the seat back flexible section, with each of the side flexible sections being extended when the frame portion is in an open position, with each of the side flexible sections having a pocket for receiving a hub post, with each of the side flexible sections extending in generally a vertical plane when said folding child booster seat is in an open position; and iv) wherein the seat back further comprises a pair of flexible flaps, with each of the flaps having a strip of vertically extending quick connect material for engaging another strip of vertically extending quick connect material on said seat back to form a through opening for each of said seat back support members, and with said flexible flaps being disengaged to permit the seat back support members to be drawn inwardly toward each other when the frame portion is to be collapsed.

20. A folding child booster seat, comprising:

a) a frame portion comprising:

i) at least four foot hubs located generally in a first plane, wherein each of said at least four foot hubs includes a lower face;

ii) at least four seat hubs located generally in a second plane, with two of said at least four seat hubs having a hub post, and with said hub post extending upwardly;

iii) a front X structure engaged between two of the foot hubs and two of the seat hubs;

iv) a rear X structure engaged between two of the foot hubs and two of the seat hubs;

v) a right side X structure engaged between two of the foot hubs and two of the seat hubs;

vi) a left side X structure engaged between two of the foot hubs and two of the seat hubs;

vii) wherein each of the X structures includes a pair of pivoting support members pivotally joined to each other, with each of the pivoting support members having a pair of end portions, with one of said end portions being pivotally joined to one of said foot hubs and with said other of said end portions being pivotally joined to one of said seat hubs; and viii) a pair of seat back support members, with each of the seat back support members engaged to one of the foot hubs, with each of the seat back support members slideably engaged to one of the seat hubs;

b) a seat portion engaged to the frame portion; and c) a set of four flexible base members engaged to said at least four foot hubs, with said set of four flexible members including a front flexible base member, a rear flexible base member, a left side flexible base member and a right side flexible base member, and wherein said flexible members are engaged at the lower faces of said front and rear foot hubs.

21. The folding child booster seat according to claim 20, wherein said flexible members extend under and cover the lower faces of said front and rear foot hubs.

* * * * *